US006736501B2

(12) United States Patent
Yamaguchi et al.

(10) Patent No.: US 6,736,501 B2
(45) Date of Patent: May 18, 2004

(54) PLATEN AND PRINTER USING THE SAME

(75) Inventors: Yoshinori Yamaguchi, Kanagawa (JP); Yukio Honda, Tokyo (JP); Akio Hosaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/077,818

(22) Filed: Feb. 20, 2002

(65) Prior Publication Data

US 2002/0118266 A1 Aug. 29, 2002

(30) Foreign Application Priority Data

Feb. 23, 2001 (JP) ..... 2001/048427

(51) Int. Cl.[7] ..... B41J 11/06
(52) U.S. Cl. ..... 347/104
(58) Field of Search ..... 347/8, 104, 220, 347/262, 264; 400/29, 48, 24, 648, 656; 271/264

(56) References Cited

U.S. PATENT DOCUMENTS 4,723,129 A * 2/1988 Endo et al. ..... 347/45
5,625,398 A * 4/1997 Milkovits et al. ..... 347/104
6,561,641 B1 * 5/2003 DeFosse et al. ..... 347/104

FOREIGN PATENT DOCUMENTS

WO WO 99/65697 * 12/1999 ..... B41J/11/06

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

A platen structure for a printer includes rigid members and a plurality of support parts disposed along the platen length to support a recording medium. Any warp due to integrated molding of the platen or any aging change due to influence of environmental conditions can be avoided.

11 Claims, 5 Drawing Sheets

PLATEN AND PRINTER USING THE SAME

BACKGROUND OF THE INVENTION

1. Field of the Invention

The present invention relates to a printer and in particular to its platen structure.

2. Related Background Art

A typical printer generally comprises a recording sheet supplier for separately supplying a recording sheet stored therein (e.g., recording paper), a recording-sheet conveyance section composed of a conveyance roller for feeding the sheet sent separately into a recording area and its driven roller, a recording head for recording onto a recording sheet, a platen for at least supporting the back face of the site of a recording sheet corresponding to the recording area recorded by the recording head, and a discharge section for discharging the recording sheet on which recording has been completed.

The recording sheet supplied by a recording sheet supplier is held between a conveyance roller and its driven roller and is sent onto the platen corresponding to a recording area by the conveyance roller. And, on the recording sheet, one or several setup lines of image recording is made by means of a recording head. After repeating the recording sheet conveyance and the image recording of one or several lines in succession till the data sent from the host computer side comes to an end, a printer discharges the recording sheet to a tray.

In such printers, most platens are integratedly formed of a resin. By appropriately selecting the molding conditions such as smoothness of the surface, planarity of the smoothness or height of a rib installed protuberantly on the surface, a platen molded of a resin or an elastic member is capable of implementing high accuracy. Furthermore, lightening of the total weight can be achieved. Or, because of a high degree of freedom in shape, they are advantageous also in easily overcoming a problem that restrictions are imposed thereon such as positioning or fitting to the surrounding construction.

In an ink jet printer for discharging ink droplets to a recording sheet to make a record, for example, the platen in the recording area is generally broader in width than a recording sheet conveyed thereto, and with respect to the conveyance direction of recording sheets, the platen is most ideally constructed so as to be broader than the recording width by means of a recording head for all recording areas and as to keep a uniform distance between a recording sheet and the recording head. Besides, the surface of the platen for supporting the recording sheet conveyed thereto is mostly a smooth plane or is equipped with a plurality of rib-shaped objects with a smooth plane parallel to the conveyance direction of recording sheets provided thereon. By attaching and fixing such a platen to a given position of a chassis or the like of a printer body, the distance between a recording head section for discharging a recording liquid and a recording sheet is kept to a given interval or a given positional relation (e.g., a mutual positional relation such that the distance between the nearest site of a recording sheet to a recording head and the recording head is prevented from becoming inferior to a given value) and a high grade of image recording is formed.

FIG. 5 shows one example of the shape of a platen made by the resin molding. On the top face of the platen 50 corresponding to the recording area defined by the recording head section, a plurality of rib-shaped objects is formed in parallel with the conveyance direction of the recording sheets. The recording sheet conveyed is pressed to a top face of a rib 51 and placed so as to establish the surface position of the recording sheet by taking the rib height of the platen that supports a back face of the recording sheet as a reference. Taking the rib height of the platen as a reference makes it possible in an ink jet printer, for example, to maintain the distance between a recording sheet and the recording head to a given interval or a constant distance in a recording area and to make a more uniform image recording while avoiding the contact between a recording sheet and the recording head in all recording areas. At this time, in order to make a high grade image recording, high accuracy is required at the height of a sheet passing surface corresponding to the height reference of a recording sheet on the platen and the position thereof. The platen illustrated here is U-shaped with the rib-surface taken as the top face for the purpose of raising the rigidity so that it is affected as little as possible by warping or the like.

In some cases of molding a platen of a resin or an elastic member, however, a problem arises in that warping in the mold occurs on account of a lag of cooling time due to the internal stress or casting of a resin or the like. This is apt to occur mainly along the length of the platen in which rigidity becomes difficult to obtain. Especially, in some cases of a plurality of rib-shaped conveyance members provided on the top face of a platen in parallel to the conveyance direction of the recording sheets, on account of the internal stress of a resin during the cooling, the conveyance guides have mutually affected the occurrence of warp of the whole platen along the length of the platen also. Besides, when the width of the corresponding recording sheet is broadened and the length of a platen along the crossing direction of recording sheet conveyance is correspondingly increased, and further, with an increase in the recording area in the direction of recording sheet conveyance due to an increase in the number of nozzles of the recording head or the like, the amount of deformation due to warp was more likely to increase. To prevent such a problem, it was necessary to suppress the deformed amount of the platen to the minimum by taking such countermeasures as to fully perform the cooling during the molding or as to make the shape of the platen into a shape less subject to the internal stress of the resin as possible.

Besides, depending on characteristics of a platen material, the platen has been subjected to an aging change under influence of external environmental conditions such as temperature and humidity after its incorporation into a printer or warping or the like has occurred on account of even minute deformation in shape due to the weight of the platen itself.

SUMMARY OF THE INVENTION

It is one object of the present invention to provide a platen, whose deformations such as warp, in particular longitudinal warp, are least likely to occur, capable of maintaining a recording medium support plane, and formed by a plurality of recording medium support parts, at a more highly accurate planarity and a printer using the same.

It is another object of the present invention to provide a platen that does not bend on account of an internal stress occurring during the resin cooling or a lag of cooling time and a printer using the same.

It is another object of the present invention to provide a platen that is not subjected to aging change after being incorporated into the printer due to influence of external environmental conditions such as temperature or humidity depending on characteristics of a platen material and a printer using the same.

It is another object of the present invention to provide a platen used for a printer, whose longitudinal component is made of a rigid member and in which a plurality of recording support parts are respectively disposed independently in a direction crossing the length and a printer using the platen.

DESCRIPTION OF THE PREFERRED EMBODIMENTS

Hereinafter, using the drawings, embodiments according to the present invention will be described in detail.

First, a platen according to the present invention will be described with respect to an applicable printer.

Figure 1:
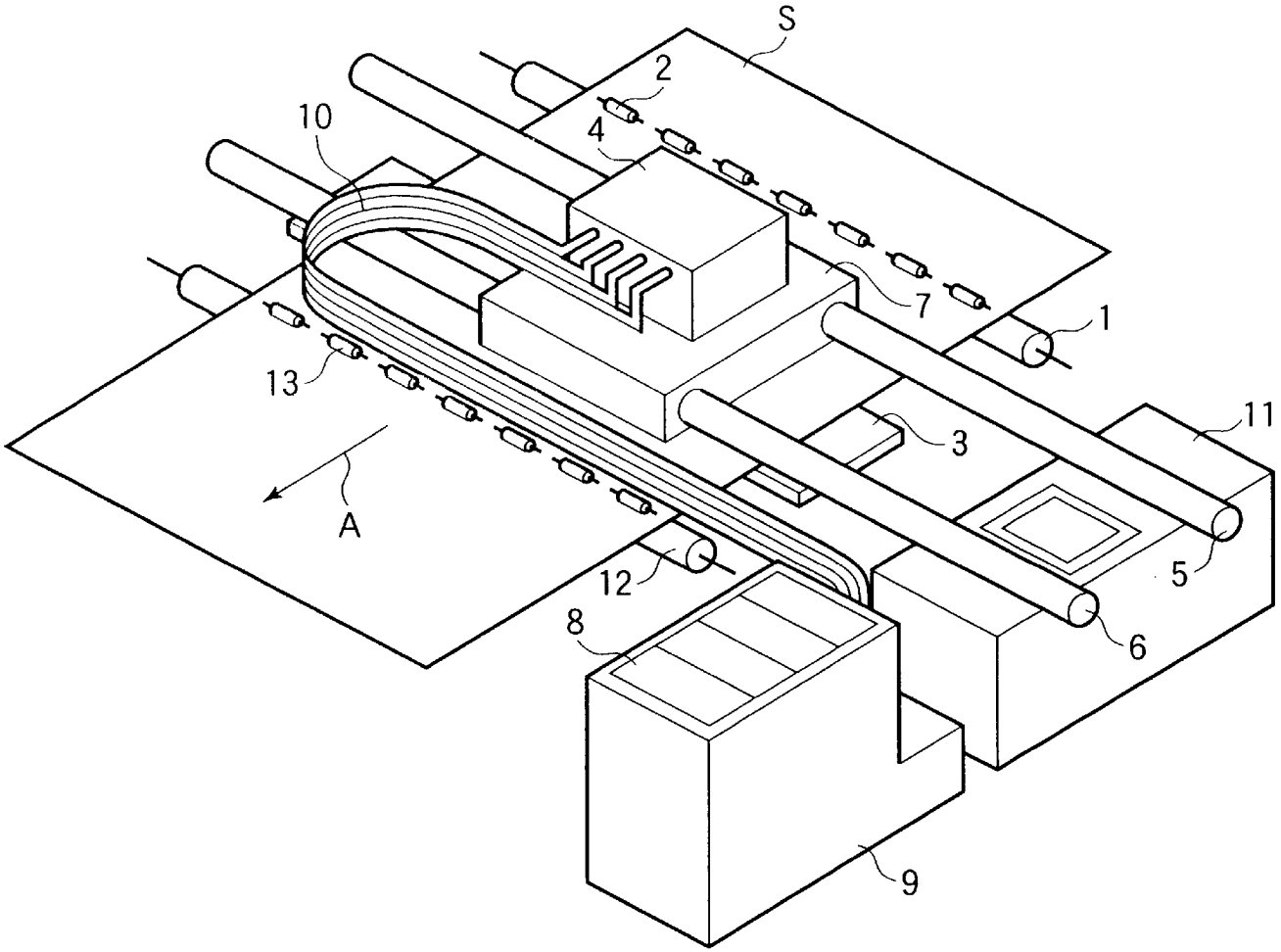
FIG. 1 is a typical perspective view of an ink jet printer, which is one example of an apparatus to which a platen of an embodiment according to the present invention is applicable.
Figure 2:
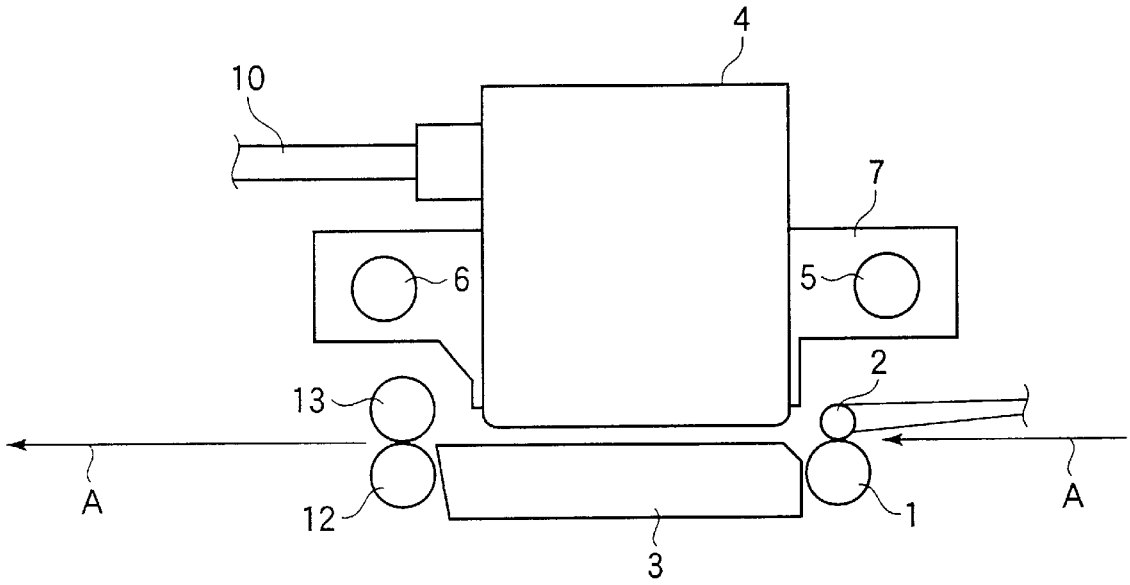
FIG. 2 is a typical sectional view taken along a conveyance direction A of a recording sheet of FIG. 1.

FIG. 1 is a typical perspective view of an ink jet printer, one example of an apparatus to which a platen of an embodiment according to the present invention is applicable, and FIG. 2 is a typical sectional view taken along the conveying direction A of the recording sheet of FIG. 1.

In FIGS. 1 and 2, a recording sheet S serving as the recording medium is held between a conveyance roller 1 and a pinch roller 2 driven thereby and conveyed in the direction of arrow A by the rotation of the conveyance roller 1 while being guided and supported by a platen 3. At this time, the platen 3 supports the recording sheet S so as to maintain the distance between the ink discharge surface of the ink jet head 4 and the recording sheet surface opposed thereto constant (at least at a minimum distance, lest the recording sheet should come into contact with the ink jet head).

The ink jet head 4 is removably mounted on a carriage 7 reciprocated along two guide rails 5 and 6 by driving means such as a motor (not shown) or the like so as to take a posture allowing ink to be discharged toward a recording sheet S. The moving direction of this carriage, crossing the direction of recording sheet conveyance (direction of arrow A), most desirably at a right angle, is referred to as the main scan direction. In contrast to this, the direction of recording sheet conveyance is referred to as the sub-scan direction.

The ink jet head 4 is equipped with a device (e.g., an exothermic resistance element) for generating thermal energy as the energy used for ink discharge and uses a scheme of causing the state change of ink (film boiling) by means of the thermal energy, in particular among various ink jet recording schemes, to attain a high density, high quality record. Incidentally, the present invention is not limited to such a scheme using thermal energy but also one using vibrational energy in which a piezoelectric element or the like is used to generate vibration, thus discharging ink.

The ink jet head 4 is equipped with multiple rows of nozzles for individually discharging different colors of ink. And, corresponding to colors of ink discharged from the ink jet head 4, multiple independent ink tanks 8 are removably mounted to a tank mounting unit 9. The tank mounting unit 9 and the ink jet head 4 are connected to each other through multiple liquid supply tubes 10 corresponding to respective ink colors and individual ink tanks 8 are mounted on the tank mounting unit 9, thereby enabling ink of the color accommodated in each ink tank 8 to be independently supplied to its respective nozzle row in the ink jet head 4 corresponding to each ink color.

After the image recording is carried out, the recording sheet S conveyed onto the platen 3 is guided to a discharge roller 12 and a spur 13, and discharged from the platen 3 (space formed by the opposed arrangement of the ink jet head 4 and the platen 3) by the rotational drive of the discharge roller 12.

Furthermore, in a non-recording area within the reciprocating range of the ink jet head 4 and outside the width of a recording sheet S during conveyance, a recovery unit 11 is so disposed as to be opposed to the ink discharge surface of the ink jet head 4. The recovery unit 11 includes a cap part for capping the ink discharge surface of the ink jet head 4, a suction mechanism for the forcible suction of ink from the ink jet head 4 in the state where the ink discharge surface is being capped and a cleaning blade for wiping smudge off the ink discharge surface.

Here, a so-called serial type ink jet printer that reciprocates the recording head across the direction of recording sheet conveyance is being described as merely one example, but the present invention is also applicable to a printer having a line type ink jet head with a line of nozzles provided along the whole width of a recording sheet. In either case, a platen equipped with a holding member capable of holding a recording head at a position opposed thereto is only required.

Next, referring to embodiments of platens according to the present invention below, a description will be made.

First Embodiment

Figure 3:
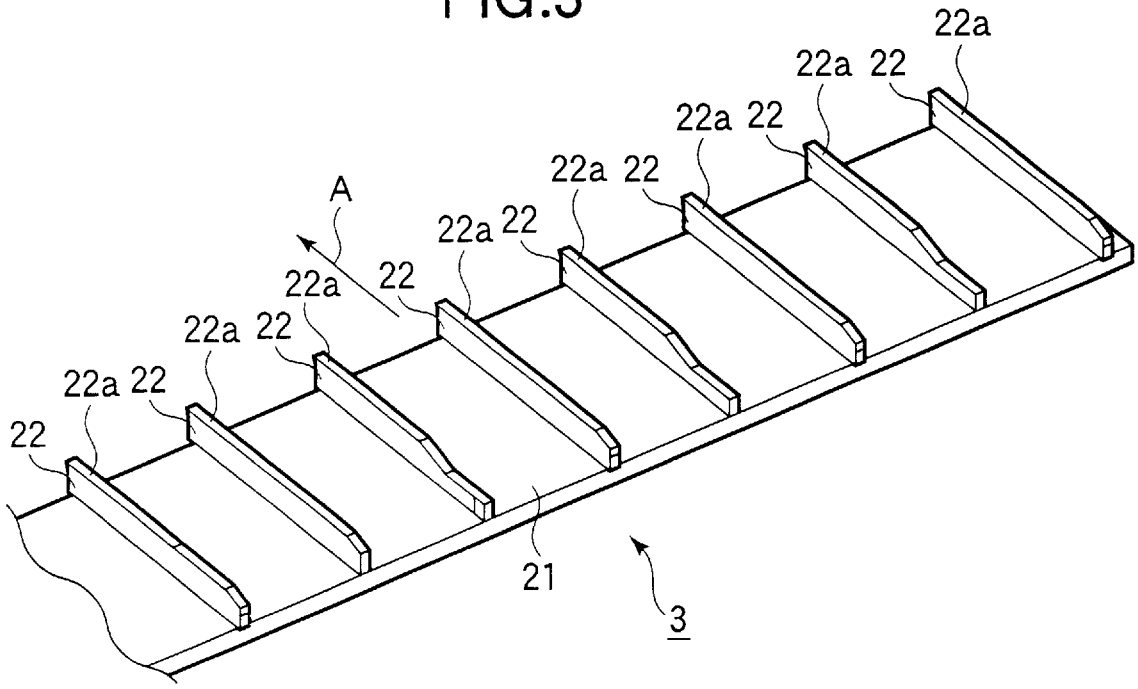
FIG. 3 is a schematic perspective view showing a first embodiment of the platen according to the present invention.

FIG. 3 is a schematic perspective view showing a first embodiment of the platen according to the present invention, which represents an example of a form applicable to the platen 3 shown in FIGS. 1 and 2.

In this embodiment, as shown in FIG. 3, the platen 3 in length is made up of a plate-shaped rigid member 21 higher in rigidity than a resin that has been so far used as the platen material, while a plurality of conveyance guide members (support parts of a recording member) 22 are disposed protuberantly in a conveying direction A of the recording sheet crossing or nearly perpendicular to its length so as to be respectively arranged at any interval in an independent state on the top face of the rigid member 21. If so shaped as able to protuberantly install a plurality of conveyance guide members 22 longitudinally (in a direction crossing that of recording sheet conveyance), the rigid member 21 is not limited to such a plate-shape as shown in FIG. 3, but is so shaped as to constitute a single platen as a whole together with a plurality of conveyance guide members. Besides, the conveyance guide member 22 is molded of a resin or an elastic member.

With the above form, since individual conveyance guide members 22 made from resin are attached to the rigid member 21 so as to be respectively retained independently, no problem arises as in case of making the whole platen into a single piece of resin mold, namely no problem that the resin bends on account of a stress during the molding or a lag of cooling time in the longitudinal direction of an integrated platen including the conveyance guide members, and therefore a problem of a platen warp along the length is solved. Besides, as a result of the fact that a conveyance guide member of a resin material is not continuous and a rigid member is provided along the length and because of a platen of a hardly deformable structure, the possibility that a platen is subjected to aging changes after being incorporated into a printer under influence of external environmental conditions such as temperature and humidity depending on characteristics of a platen material is also avoided.

Furthermore, by shaping the recording sheet support surface (a virtual surface obtained by tying a plurality of conveyance guide members 22 so as to include their top faces, corresponding to a sheet surface when a highly rigid sheet is placed on a plurality of conveyance guide members 22) at high accuracy, the planarity of the virtual surface along the length of the platen basically depends on a longitudinal warp occurring on the platen and never fails to depend on the attaching accuracy of the rigid member 21 in the end. Thereby, while keeping higher accuracy over a broad range on the platen surface, it is possible to make the distance between the surface supporting the back face of a recording sheet on the platen and the ink discharge port face of the ink jet recording head extremely uniform. By making uniform the distance between the recording sheet support surface, such a virtual surface as to include the top faces 23*a* of a plurality of ribs (forming the surface supporting the back face of a recording sheet) provided on the surface of the platen and the ink discharge port face of the ink jet recording head, it becomes possible to set the interval between the recording sheet and the ink discharge port face to a given value, thereby enabling the grade of an image record to be stabilized and a highly accurate image record to be obtained.

Second Embodiment

Figure 4:
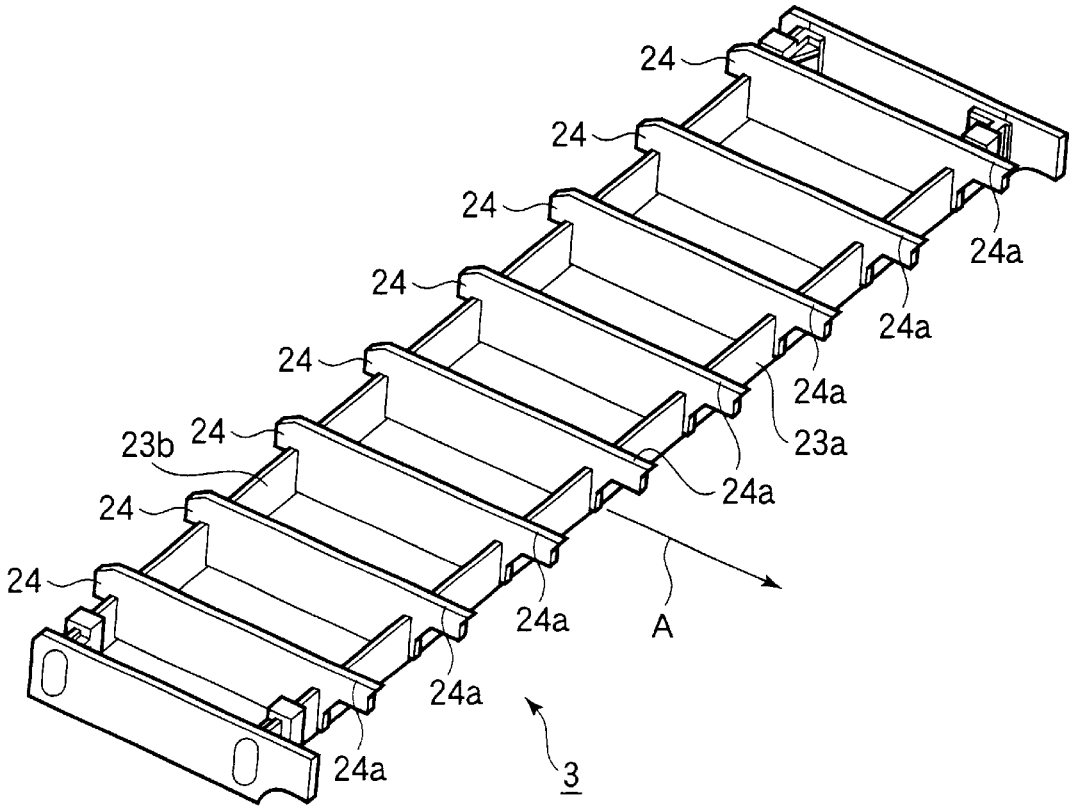
FIG. 4 is a schematic perspective view showing a second embodiment of the platen according to the present invention.
Figure 5:
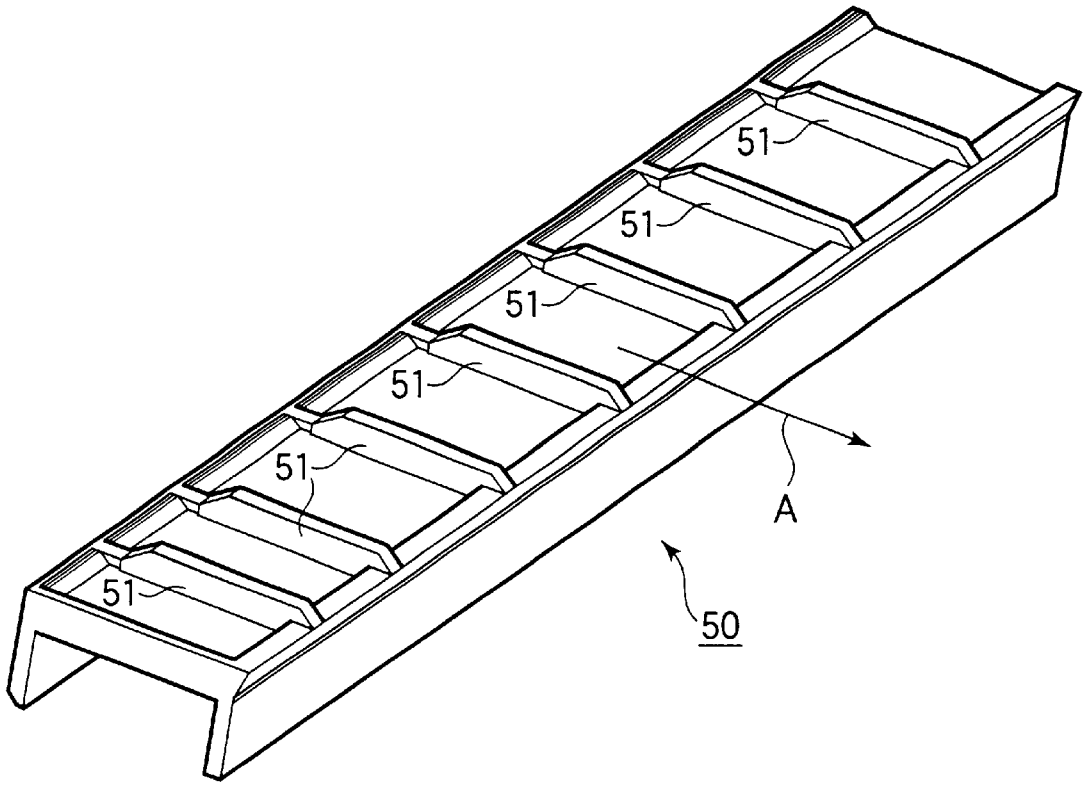
FIG. 5 is a schematic perspective view showing one example of the shape of a conventional platen.

FIG. 4 is a schematic perspective view showing the second embodiment of the platen according to the present invention, which represents another example of a form applicable to the platen 3 shown in FIGS. 1 and 2.

In this embodiment, as shown in FIG. 4, the platen 3 in length is made up of two rigid members 23*a* and 23*b*, while a plurality of conveyance guide members (support parts of a recording member) 24 are disposed in the direction A of recording sheet conveyance so as to be respectively arranged at any desired interval in an independent state as with the first embodiment. And, together with the rigid members 23*a* and 23*b*, the conveyance guide members 24 assume a structure constituting a single platen. Besides, as evident from FIG. 4, the rigid members 23*a* and 23*b* are respectively disposed near the end faces of the conveyance guide members 24 in the direction A of recording sheet conveyance. Further, the rigid members 23*a* and 23*b* and individual conveyance guide members 24 are composed so as to cross each other face to face.

Here, the rigid members 23*a* and 23*b* can support a plurality of conveyance guide members 24 in the longitudinal direction (in the direction perpendicular to the conveyance direction of the recording sheets) and are not limited to such a shape as shown in FIG. 4 but may be of a rod-shape extending longitudinally, so long as they are higher in rigidity than a resin material usually used as the platen material. Besides, it is only necessary that a plurality of conveyance guide members 24 are retained on the rigid members 23*a* and 23*b* so as not only to arrange their top faces 24*a* along the direction of recording sheet conveyance, but also to set the interval between such a virtual surface, defined by the top faces 24*a* of the plurality of conveyance guide members 24, and the ink jet recording head to a most suitable distance for ink jet recording. Thus, if the rigid members 23*a* and 23*b* and the conveyance guide members 24 are fitted with each other so as able to support the back face of the recording sheet conveyed without inconvenience, their fitting condition may be of an engagement structure or a matching structure, but is preferably constructed by the insert molding comprising casting a resin material into a mold with rigid members disposed therein to substantially integrate both of them.

Since individual conveyance guide members 24 made of a resin or the like are respectively disposed independently the rigid members 23*a* and 23*b*, as with the first embodiment, such construction is not affected by a problem with integration of the whole platen into a resin molding, namely a problem that a resin bends on account of a stress during the molding or a lag of cooling time along the length of a platen integrated inclusive of conveyance guide materials, thus solving the effect that the platen bends along the length. Besides, because of the hardly deformable construction of a platen with conveyance guide materials of a resin material not continuous along the length which comprises rigid members along the length, the possibility is excluded that the platen is subjected to aging changes after being incorporated into a printer under influence of external environmental conditions such as temperature and humidity depending on characteristics of a platen material.

Furthermore, by disposing the rigid members 23*a* and 23*b* along the length of a platen 3 near the end faces of the conveyance guide members 24 in the conveying direction A the occurrence of inclination, warp and so on of the whole recording sheet support surface of the platen 3 at the printer installation can be suppressed.

Besides, with this construction, decreasing the volume of the rigid members themselves becomes possible, thereby enabling the weight of the platen itself to be reduced and moreover the cost to be saved. Furthermore, a problem that the weight of the platen itself causes a deformation in its shape and warping or the like can be diminished. When the platen construction of arranging a plurality of rigid members in parallel along the length is chosen as with this embodiment, in the direction of a longitudinal section of the rigid member, the influence of flexure due to the weight of the rigid bodies themselves is hardly apt to occur and both smallness in volume and lightness in weight can be implemented. From such a viewpoint, a shape of rigid members greater in sectional second moment and higher in rigidity is desirable.

Incidentally, in the first and second embodiments mentioned above, rigid members 21, 23*a* and 23*b* have only to be rigid bodies in which no deformation such as warp or twist occurs and whose shape can be maintained at high accuracy, and iron, aluminum and reinforced plastics, for example, are usable. Besides being integratedly molded using insert molding or the like, rigid members 21, 23*a*, 23*b* and conveyance guide members 22, 24 may be fixed by means of screws, caulking or the like unless any problem occurs in accuracy.

According to either of the embodiments mentioned above, a platen in length comprises rigid members and a plurality of support parts for a recording medium are individually disposed independently in the direction perpendicular to the platen length and the embodiments are formed so as to constitute the platen together with the relevant rigid members, thereby enabling the influence of deformations such as warp due to an internal stress or aging changes along the length of the platen to be suppressed.

Furthermore, in a platen corresponding to a printer construction usable with a recording sheet great in width or a printer construction wide in recording area in the conveyance direction of the recording sheets, the influence of warp can be diminished to a greater extent and its displayed effect is great.

Especially, in case of applying this platen to an ink jet printer, it becomes possible to more stably retain the distance between an ink jet recording head and a recording sheet support surface at a constant or given interval and high grade image recording can be always carried out.

What is claimed is:

1. A platen for use in a printer having a holding member for holding an ink jet recording head, said platen comprising:

a plurality of support members extending in a conveyance direction of a recording medium to support the recording medium; and a plurality of rigid members for supporting said support members, said rigid members being formed of a material having rigidity higher than that of said support members, wherein said support members are positioned so as to be opposable to a position at which the ink jet recording head is held by the holding member and said plurality of rigid members are disposed in parallel with each other along the length of said platen.

2. The platen as set forth in claim 1, wherein said support members are formed of a resin or an elastic material.

3. The platen as set forth in claim 1, wherein said support members are rib-shaped so that their top faces support the back face of the recording medium.

4. A printer comprising:

a plurality of support members extending in a conveyance direction of a recording medium to support the recording medium;

a plurality of rigid members for supporting said support members, said rigid members being formed of a material having rigidity higher than that of said support members; and a holding member for holding an ink jet recording head at a position opposable to said support members, wherein said plurality of rigid members are disposed in parallel with each other along the length of a platen formed thereof.

5. The printer as set forth in claim 4, wherein said support members are formed of a resin or an elastic material.

6. The printer as set forth in claim 4, wherein said support members are rib-shaped so that their top faces support the back face of the recording medium.

7. The printer as set forth in claim 4, wherein said support members and said rigid members comprise the platen, which is disposed in said printer so as to set an interval between a virtual surface defined by the top faces of the plurality of said support members with the recording medium disposed thereon and the ink jet recording head to a given distance.

8. The printer as set forth in claim 4, wherein the ink jet recording head discharges ink droplets onto the recording medium disposed on the support members to make a record.

9. The printer as set forth in claim 8, wherein said ink jet recording head ejects the ink droplets by applying thermal or vibrational energy to the ink in a nozzle.

10. A platen for use in a printer having a holding member for holding an ink jet recording head, said platen comprising:

a plurality of rib-like support members extending in a conveyance direction of a recording medium and formed of resin or elastic material to support the recording medium; and a plurality of rigid members extending in a direction transverse to the conveyance direction of the recording medium to support said support members, said rigid members being formed of a material having rigidity higher than that of said support members, wherein said support members are positioned so as to be opposable to a position at which the ink jet recording head is held by the holding member, and wherein said plurality of rigid members are disposed in parallel with each other along the length of said platen.

11. A printer comprising:

a plurality of rib-like support members extending in a conveyance direction of a recording medium and formed of resin or elastic material to support the recording medium;

a plurality of rigid members extending in a direction transverse to the conveyance direction of the recording medium to support said support members, said rigid members being formed of a material having rigidity higher than that of said support members; and a holding member for holding an ink jet recording head at a position opposable to said support members, wherein said plurality of rigid members are disposed in parallel with each other along the length of a platen formed thereof.

* * * * *